United States Patent [19]

Popplewell et al.

[11] 4,119,313

[45] Oct. 10, 1978

[54] GAMES RACQUETS

[75] Inventors: Frank William Popplewell, Saffron Walden; Frank Raymond Houghton, Cambridge, both of England

[73] Assignee: Dunlop Limited, England

[21] Appl. No.: 700,499

[22] Filed: Jun. 28, 1976

[30] Foreign Application Priority Data

| | | | |
|---|---|---|---|
| Jul. 12, 1975 | [GB] | United Kingdom | 29388/75 |
| Oct. 17, 1975 | [GB] | United Kingdom | 42603/75 |
| Feb. 7, 1976 | [GB] | United Kingdom | 4836/76 |

[51] Int. Cl.[2] ..... A63B 49/02

[52] U.S. Cl. ..... 273/73 K; 273/73 C; 273/73 G

[58] Field of Search ..... 273/73 R, 73 C, 73 D, 273/73 F, 73 G, 73 H, 73 K

[56] References Cited

U.S. PATENT DOCUMENTS

| | | | |
|---|---|---|---|
| 1,381,050 | 6/1921 | Agutter | 273/73 K |
| 1,470,878 | 10/1923 | Robinson | 273/73 D |
| 1,502,845 | 7/1924 | Blache | 273/73 D |
| 1,508,286 | 9/1924 | Moore | 273/73 K |
| 1,676,051 | 7/1928 | Robinson | 273/73 H |
| 1,930,285 | 10/1933 | Robinson | 273/73 D X |
| 1,937,787 | 12/1933 | Robinson | 273/73 H |
| 2,274,788 | 3/1942 | Hatton | 273/73 K |
| 2,742,289 | 4/1956 | Allward | 273/73 H |
| 3,083,968 | 4/1963 | Takahashi | 273/73 R |
| 3,352,566 | 11/1967 | Kennedy | 273/73 K X |
| 3,545,756 | 12/1970 | Nash | 273/73 D X |
| 3,568,290 | 3/1971 | Carlton | 273/73 C |
| 3,664,668 | 5/1972 | Held | 273/73 D X |
| 3,809,402 | 5/1974 | Haines et al. | 273/73 C |
| 3,986,716 | 10/1976 | Taussig et al. | 273/73 C |
| 3,990,701 | 11/1976 | Kim | 273/73 K X |

FOREIGN PATENT DOCUMENTS

| | | | |
|---|---|---|---|
| 238,250 | 4/1962 | Australia | 273/73 H |
| 1,923,910 | 10/1969 | Fed. Rep. of Germany | 273/73 R |
| 2,621,062 | 2/1976 | Fed. Rep. of Germany | 273/73 H |
| 15,834 | 6/1962 | Japan | 273/73 C |
| 30,864 | 4/1975 | Japan | 273/73 C |
| 21,648 | 9/1913 | United Kingdom | 273/73 K |
| 239,446 | 9/1925 | United Kingdom | 273/73 K |
| 731,483 | 6/1955 | United Kingdom | 273/73 K |
| 1,021,278 | 3/1966 | United Kingdom | 273/73 H |
| 1,113,707 | 5/1968 | United Kingdom | 273/73 H |
| 1,126,438 | 9/1968 | United Kingdom | 273/73 C |
| 1,223,834 | 3/1971 | United Kingdom | 273/73 G |
| 1,271,318 | 4/1972 | United Kingdom | 273/73 H |
| 1,304,015 | 1/1973 | United Kingdom | 273/73 H |
| 1,307,305 | 2/1973 | United Kingdom | 273/73 F |
| 1,311,925 | 3/1973 | United Kingdom | 273/73 H |

*Primary Examiner*—Richard J. Apley
*Attorney, Agent, or Firm*—Stevens, Davis, Miller & Mosher

[57] ABSTRACT

The invention provides a frame for a games racquet, e.g. a badminton racquet, formed from a plastics material reinforced with a circumferentially-extending tubular metal member. The tubular metal member may be visible in the surface of the product, e.g. running the length of the inner periphery of the head of the frame.

28 Claims, 18 Drawing Figures

GAMES RACQUETS

This invention relates to frames for games racquets. It is particularly concerned with composite frames of plastics material reinforced with metal.

According to one aspect of the present invention there is provided a frame for a games racquet in which at least part of the frame is constructed of plastics material in which is incorporated a circumferentially-extending tubular metal reinforcement.

Preferably the metal tube is orientated in the frame so as to substantially increase the stiffness of the frame in bending due to loads perpendicular to the plane of the strings of the racquet — e.g. as it would be loaded when the racquet strikes a ball or shuttlecock.

In a preferred embodiment the head, i.e. stringing, portion of the frame is a loop of moulded plastics material and the tubular metal reinforcement runs the length of substantially the whole loop.

The construction of the present invention is particularly, though not exclusively, suitable for use with racquet frames of fibre-reinforced plastics materials. For example, plastics material containing fibre reinforcement such as carbon fibre, glass fibre, or aromatic polyamide fibres such as "Kevlar" have been found suitable for constructing such racquets. ("Kevlar" is a Registered Trade Mark).

The use of carbon fibres is particularly preferred, materials containing over 20% by weight of carbon fibres being considered particularly satisfactory.

The plastics material may be a thermoplastic material, e.g. nylon, poly-propylene, polycarbonates and acrylonitrile-butadiene-styrene copolymers.

The tubular metal reinforcement is preferably of stainless steel, but other metals may be used, e.g. aluminium, titanium, their alloys, and various alloy steels. It is however important that the metal reinforcement be a completely enclosed tube, i.e. not merely channel-shaped, over substantially its whole length.

In one embodiment the metal tube may be embedded rigidly in position in the plastics moulding by moulding the plastics material around the tube — e.g. by means of an injection moulding process. Alternatively the plastics part of the racquet frame may be moulded in two or more separate parts and the parts joined together with the metal tube by means of a suitable adhesive. Where the plastics material is injected around the metal tube attachment between the metal and the plastics may be enhanced by means of perforations in the metal or by the addition of lugs to the surface of the metal component. The metal may also be perforated to reduce the weight of the frame.

The perforations in the metal tube may be arranged so that they correspond to the positions at which the string passes through the frame and are of such a size that the strings do not contact the metal. Preferably the stringing holes are moulded into the plastics part during the moulding process.

The tubular member may remain hollow in the finished product or it may be (and if perforated will — to at least a certain extent — be) filled with the plastics material. Alternatively, if desired, the tube could be filled with the same or a different plastics material prior to its being incorporated in the frame.

It will be appreciated that the directional stiffness of the racquet frame is closely related to the choice of cross-section of the metal tube. A cross-section which has its major width aligned perpendicular to the strings of the racquet will significantly increase stiffness in this direction. Because the metal component will add significantly to the weight of the racquet frame, the cross-section must be carefully chosen to optimize stiffness in the desired direction and to minimize weight.

The cross-section of the metal tube may be circular, elliptical or of any other regular, or even irregular configuration, as desired. A particularly preferred cross-section, especially for badminton racket frames is substantially 'D'-shaped but in which the conventionally straight side of the *D*' is arched in the opposite direction to the curved portion of the '*D*'.

In a particularly preferred embodiment the metal tube may be partially visible on the surface of the frame. Thus in another aspect the invention provides a racquet frame comprising a head portion in the form of a loop of fibre-reinforced plastics material with a tubular metal reinforcement running around the loop, a portion of the circumference of the tube being embedded in the plastics material and the remainder of the circumference being visible in the surface of the frame. In this embodiment the metal tube may be positioned so that it appears preferably on the inner periphery of the frame loop.

The construction of the present invention may be used for the complete racquet frame (consisting of both head and shaft), or alternatively only a part may be so constructed. For example, a racquet frame could comprise a head constructed according to the invention attached to a separate metal shaft. The metal shaft would normally be of tubular form and it may be attached to the head by means of an adhesive or alternatively the head may be moulded to the shaft by inserting the shaft into the mould in the appropriate position so that it becomes an integral part of the moulding. Satisfactory keying between the shaft and the head may be best obtained by shaping the end of the tube by, for instance, flattening it, and the hollow interior of the shaft is closed by this or by an alternative means to prevent the ingress of plastic material in the moulding operation.

The reinforcement may, if desired, be shaped and the ends abutted or joined to form a continuous loop prior to fitting the shaft; alternatively the reinforcement may be specially shaped in the region of the racquet throat to provide added strength at this point.

If desired the frame may be painted or varnished.

It will be appreciated that certain areas of a racquet frame undergo greater stresses in use than other areas. Thus, areas such as the throat area of the frame are preferably made stiffer than, say, the top of the head area of the frame. This can be readily achieved in frames of the present invention by forming the plastics frame of varying thickness. The section, i.e. thickness of the plastics material, can easily be increased in the throat area by a suitable increase in mould dimensions in that area.

The racquet frame of the invention can be considered to be predominantly of the plastics material reinforced with the tubular metal member. As an illustration, for a badminton racquet the volume of plastics material (including fibre-reinforcement where provided) to metal in the composite could, for example, suitably be 90:10. By weight the ratio could suitably be 70:30. Clearly these ratios may vary according to the type of racquet desired and suitable values may readily be found by the skilled man of the art for any particular purpose.

From the point of view of increasing the strength and stiffness of the frame, the larger the diameter of tube used the greater will be the effect. However, it will be appreciated that there are overall considerations of maximum weight and maximum acceptable cross-sections within which the reinforcement must be accommodated for any particular type of racquet.

Similarly the wall thickness of the metal tube used may be varied quite widely and will depend on the type of racquet, the particular metal and the weight/diameter limitations. We have found the following wall thickness ranges and tube diameters to be particularly useful but the actual values used can of course be varied according to any particular, specific requirements.

Badminton

Preferred external tube major diameter ¼ to ⅓ inch (6.30 mm to 8.40 mm).

Preferred wall thickness 0.006 to 0.012 inch (0.15 mm to 0.30 mm)

Squash

Preferred external tube major diameter ¼ to ⅜ inch (6.30 mm to 9.60 mm).

Preferred wall thickness 0.008 to 0.014 inch (0.20 mm to 0.36 mm)

Tennis

Preferred external tube major diameter ⅜ to ⅝ inch (9.50 mm to 16.0 mm)

Preferred wall thickness less than 0.020 inch (0.50 mm)

(especially 0.010 to 0.015 inch) (0.25 mm to 0.40 mm)

These measurements are particularly advantageous for stainless steel tubes.

Similarly, the extent to which the plastics material surrounds the tube will affect the strength and stiffness of the frame but the skilled man of the art will readily be able to find an overall combination of dimensions and materials to give the properties he desires.

According to a further aspect of the present invention is provided a games racquet having a frame of the type described above, fitted with stringing and a handle. As indicated above, the construction of the invention may be employed in, for example, squash racquets, tennis rackets and badminton racquets.

Among advantages of making games racquet frames according to the invention are:

(1) The metal tube reduces the tendency for cold flow in the plastics material under the action of the high forces generated by the tension of the strings.

(2) The stringing holes may be moulded into the plastics material (to coincide with perforations in the metal tube). Alternatively, the entrance to the stringing holes may be moulded and the holes themselves drilled.

(3) The use of plastics materials and moulding-in of the stringing holes or the entrance to the stringing holes eliminates the use of plastic grommets which are normally required in games racquets made solely from metal to insulate the metal frame from the strings.

(4) There is a further advantage particularly applicable to badminton racquets. All-plastic-framed badminton racquets have been found to be too flexible. Tubular-metal-framed badminton racquets are well known and have met with some success. However, we have found that it is desirable to decrease the stiffness of tubular metal badminton racquets. In practice this is not so easy to achieve satisfactorily. The stiffness is principally governed by the overall diameter of the tube and hence stiffness can be decreased by using a narrower tube. Since the stringing apertures in the tube must have a certain minimum size, it is not possible to effectively reduce the tube diameter without increasing the proportion of surface area occupied by the holes. This can weaken the frame. The present invention enables a highly desirable balance of stiffness and strength to be achieved.

(5) The invention can provide racquets of increased impact-resistance. Again this is particularly so for badminton racquets. It will be appreciated that a relatively thin-walled metal badminton racquet can be dented relatively easily by impact. The present invention provides constructions in which the metal tube can be advantageously utilized while being protected from impact damage by the plastics material.

The construction of the invention is particularly useful for badminton racquets where, due to weight and strength requirements it has not hitherto been possible to construct a racquet of reinforced plastics material which could compare satisfactorily to conventional wood or metal-framed racquets. However, as indicated above it is not intended that the scope of the invention be restricted to badminton racquets.

The invention will now be further described, by way of example only, with reference to the accompanying drawings in which.

FIGS. 1 to 7 show in transverse cross-section, seven possible frame constructions in which the tubular metal member 20 is completely embedded in the fibre-reinforced plastics material 21 to form frame 22. The cross-section of the metal tube may vary quite widely as is shown. It will be appreciated that, while the cross-section of the frame is shown to be rectangular it could be of any other desired cross-section, e.g. circular or elliptical.

Figure 1:
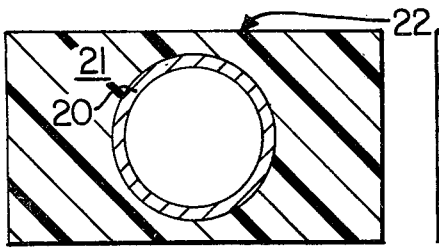
FIGS. 1 to 7 show cross-sections through seven possible racquet frame constructions illustrating the incorporation of tubular metal reinforcements of different cross-sections.
Figure 2:
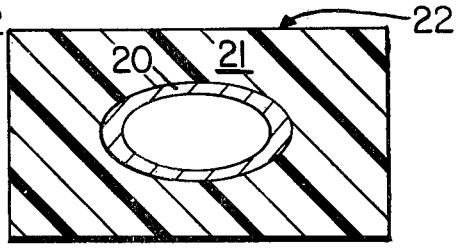
Figure 3:
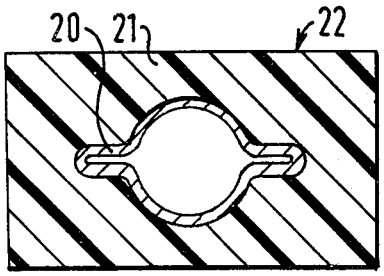
Figure 4:
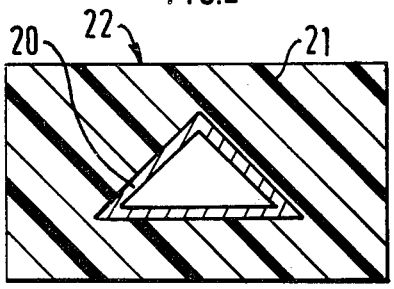
Figure 5:
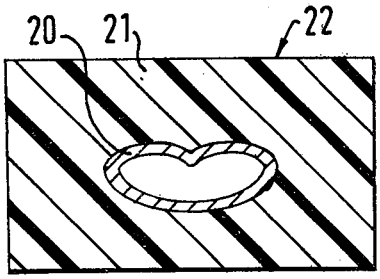
Figure 6:
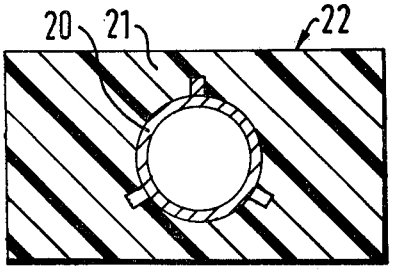
Figure 7:
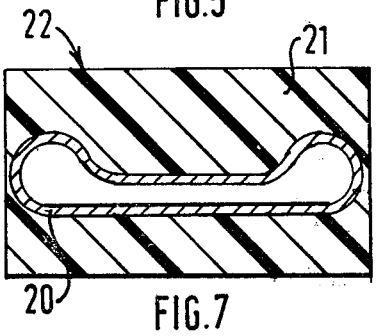
Figure 8:
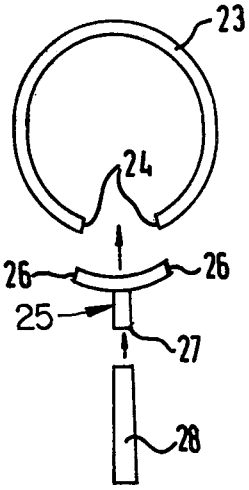
FIG. 8 is a diagrammatic representation showing one way of forming a complete racquet incorporating a frame of the invention.

In FIG. 8 is shown a racquet frame head portion 23 which is made according to one of the embodiments of the invention. It is in the form of an incomplete loop having a gap between its ends 24 in the region intended for the throat area of the racquet. A T-piece 25, which may be of tubular metal or a tubular metal/plastic composite, for example, is adapted to be fitted at its ends 26 into the ends 24 of the loop 23. End 27 of the T-piece is adapted to be fitted into a tubular metal shaft 28 to complete the racquet ready for stringing. The T-piece may be secured in position by any conventional means, e.g. rivets and/or adhesives.

Figure 9:
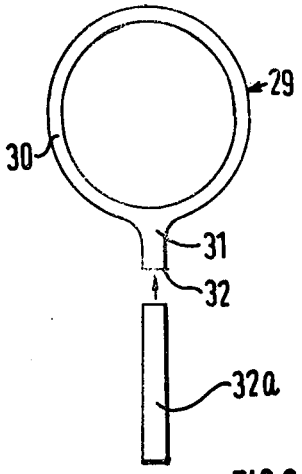
FIG. 9 is a diagrammatic representation showing an alternative way to that of FIG. 8.

FIG. 9 shows an alternative means of forming a complete racquet frame. Here frame portion 29 is formed as a completed loop portion 30 and an internal throat portion 31. End 32 of throat portion 31 is adapted to receive shaft 32*a*.

Figure 10:
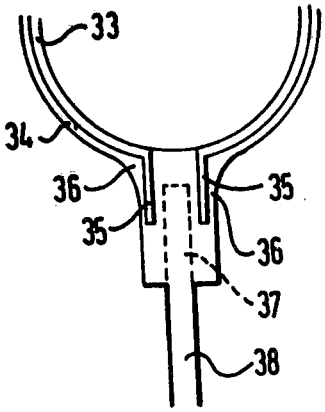
FIG. 10 is a plan view of the throat portion of a racquet incorporating a frame of the invention.

FIG. 10 shows in greater detail one possible means of joining the integral frame loop and throat portion of FIG. 9 to the racquet shaft. The frame loop consists of a tubular metal reinforcement 33 which is visible on the interior of the loop and is partially embedded in a moulded plastics frame portion 34. The metal tube 33 is in the form of an incomplete loop terminating in two extension portions 35 in the throat area 36 of the racquet. Portions 35 lie parallel to the longitudinal axis of the frame. Extension portions 35 are embedded in a thicker mass of plastics material forming the throat 36. A recess 37 is moulded into the throat area to receive a shaft 38.

Figure 11:
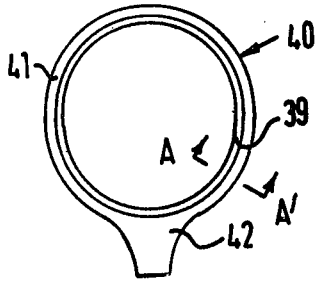
FIG. 11 is a plan view of a racquet head frame according to one embodiment of the invention.
Figure 12:
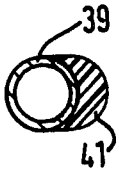
FIG. 12 is a cross-section on line $AA^1$ of FIG. 11.

FIGS. 11 and 12 show an integral racquet head and throat frame. The tubular metal reinforcement 39 is of elliptical cross-section and, as in FIG. 10, extends around the inner periphery of head loop 40, and is partially embedded in plastics material, which forms the outer periphery 41 of the head loop and also the thickened throat area 42.

Figure 13:
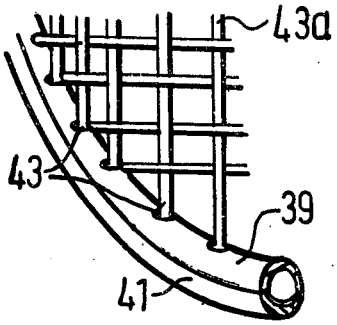
FIG. 13 is an elevation of a portion of the racquet frame of FIGS. 11 and 12, the frame being strung.

FIG. 13 shows a portion of the frame of FIGS. 11 and 12 when strung. The metal tube has stringing holes 43 formed through it and these correspond to holes formed in or drilled through the plastics portion 41 of the frame. The racquet is strung with strings 43*a* in a conventional manner.

An example of the manufacture of a badminton racquet according to the invention will now be described for illustration only with reference to FIGS. 14 to 18 of the drawings.

Figure 14:
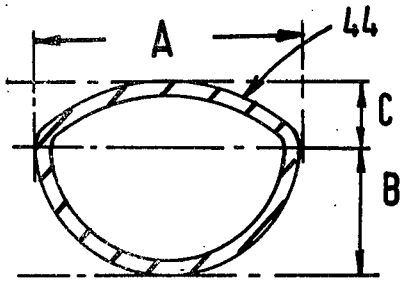
FIGS. 14 to 18 show sectional views through a frame during various stages of its manufacture.

A steel tube 44 of wall thickness 0.008 inch (0.203 mm) and of cross-section shown in FIG. 14 was used. The dimensions of FIG. 14 are:

A = 0.265 inch (6.74 mm)
B = 0.130 inch (3.30 mm)
C = 0.050 inch (1.27 mm)

(A is the 'major axis' of the 'D' and B and C is the minor axis of the 'D.' The ratio of C to B is preferably no more than 50% and may especially be in the range 30 to 40%.)

The tube was taken in its malleable state was cut to 26.8 inches (680 mm) length. It was positioned in jigs in a spark erosion machine. A series of stringing holes were produced through opposite walls (and along the length of the tube) in a direction parallel to the minor axis of the tube. The holes were 0.090 inch (2.28 mm) in diameter and were flanged in both walls 44*a* and 44*b* of the tube. The flanged holes were formed by movement of a suitable tool from the direction of wall 44*b* to produce flanges 48 and 49 (see FIG. 17) in the direction of movement of the tool, i.e. extending inwardly from wall 44*b* and outwardly from wall 44*a*.

The tube was then placed in a second jig and a second series of holes 47 (FIG. 16) of diameter 0.10 inch (2.54 mm) were formed without flanges between the flanged holes. The unflanged holes 47 were formed in wall 44*a* only of the tube.

The tube was then bent into an oval configuration appropriate to a badminton racquet with wall 44*b* on the inner periphery of the oval. One of the free ends of the oval was reduced in section by crimping so that it could be inserted into the other free end to a depth of 0.375 inch (9.55 mm). The two ends were then pinned together.

The loop so formed was hardened by well known heat treatment methods for steel tube and was then descaled and polished.

Figure 15:
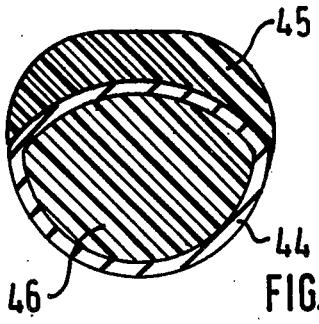
Figure 16:
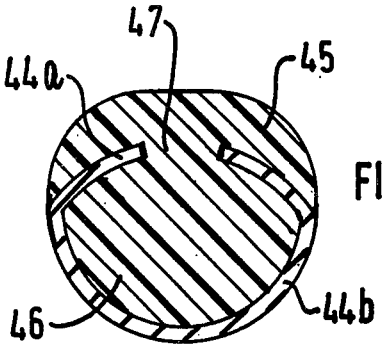
Figure 17:
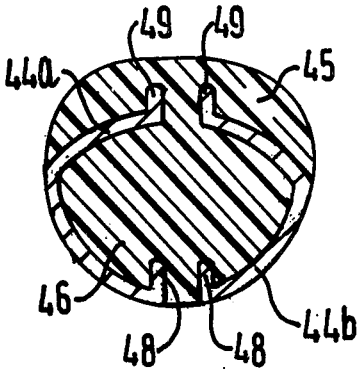

The loop was then fitted into an appropriately designed injection mould and fibre-reinforced plastics material was introduced to the interior of the tube via holes 47 and on to the outer periphery of the loop on wall 44*a*. The resulting product is illustrated in FIGS. 15, 16 and 17 which are, respectively, a section taken between holes in the tube, a section taken at the position of an unflanged hole and a section taken at the position of a flanged hole. (The plastics material used in this specific example was nylon reinforced with carbon fibres at 40% loading by weight).

It will be seen that the tube 44 was filled with plastics material 46 and that a loop of plastics material 45 was formed on the outside of tube wall 44*a*. This loop 45 had a minimum thickness in the head area of 0.138 inch (3.5 mm) and a maximum thickness in the throat area of 0.197 inch (5.0 mm).

Figure 18:
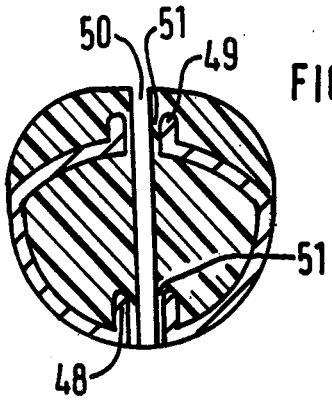

In order to string a racquet made from this frame, stringing holes can be drilled through the plastics material in positions corresponding to the flanged holes in the metal tube or the holes may be moulded in situ by using appropriate core pins. In this particular example the stringing holes 50 were drilled (FIG. 18).

It will be noted that the plastics material was arranged to insulate the sharp metal edges of flanges 48 and 49 by virtue of a plastic "lining" 51. In other words the diameter of the stringing holes is less than that of the flanged holes in the metal tube.

If desired a groove could be moulded around part of the periphery of plastic loop 45 so that the racquet strings do not stand proud of the surface of the frame in that area.

A metal shaft was attached by glueing into an appropriate cavity moulded into the throat area of the frame. (If desired the shaft could have been directly attached during the plastics moulding stage). A handle was then attached to the shaft in a conventional manner.

The racquet so obtained was strung conventionally. Physical measurements were made on the racquet and on conventional, commercially available metal badminton racquets with the results listed in the Table below.

TABLE

| Badminton Head Description | Weight of Head gms | Head Strength (Side) (kg) | Head Strength (Top) (kg) | Flexural Rigidity Shoulders $\times 10^4$N.mm$^2$ | Flexural Rigidity Top Quarter $\times 10^4$N.mm$^2$ | Frame Stiffness 10.15 cm of the frame from the top of the head clamped kg/cm deflection | Frame stiffness 10.15 cm clamped from the bottom of the shaft ferrule kg/cm deflection |
|---|---|---|---|---|---|---|---|
| Carlton 3.9 | 53.1 | 59 | 56 | 261.9491 | 233.5088 | 11.76 | 7.94 |
| Carlton | 53.0 | 45 | 40 | 227.0116 | 204.3125 | 10.58 | 8.19 |

TABLE-continued

| Badminton Head Description | Weight of Head gms | Head Strength (Side) (kg) | Head Strength (Top) (kg) | Flexural Rigidity Shoulders $\times 10^4$N.mm$^2$ | Flexural Rigidity Top Quarter $\times 10^4$N.mm$^2$ | Frame Stiffness 10.15 cm of the frame from the top of the head clamped kg/cm deflection | Frame stiffness 10.15 cm clamped from the bottom of the shaft ferrule kg/cm deflection |
|---|---|---|---|---|---|---|---|
| 4.1 Carlton 3.7 | 44.9 | 39 | 35 | 220.8822 | 215.0593 | 7.9365 | 4.62 |
| Steel Invention | 55.0 | 50 | 32.5 | 220.8822 | 120.1766 | 4.305 | 2.27 |

It will be seen that the racquet of the invention was of comparable strength to the three metal racquets while being considerably less stiff. Moreover, it will be seen from the Flexural Rigidity values that the invention has provided a racquet which is considerably less stiff in the top part of the head than in the shoulder (adjacent the throat) area. This is in marked contrast to the much smaller difference for the all-metal racquets. This difference gives a more efficient structure from the point of view of the overall distribution of stiffness and strength requirements for a given weight. In other words the weight and strength of the racquet can be better distributed so that those areas that undergo most stress are strengthened while those areas that do not require to be so strong are not unnecessarily heavy.

Having now described our invention what we claim is:

1. A frame for a games racquet having a head portion and a handle portion, the head being at least partly constructed of plastics material in which is incorporated a circumferentially-extending tubular metal reinforcement having a portion of its outer circumference defining substantially the entire inner periphery of the finished head portion, the tubular metal reinforcement having flanged stringing apertures with the flanges extending radially outwardly of the head of the frame and the plastics material defining substantially the entire outer periphery of the head portion.

2. A frame according to claim 1, in which the head portion is in the form of a loop and the tubular metal reinforcement runs around substantially the whole loop.

3. A frame according to claim 1, in which the plastics material is selected from the class consisting of nylon, polypropylene, polycarbonate and acrylonitrile-butadiene-styrene copolymers, and is reinforced with carbon fibres.

4. A frame according to claim 1, in which the tubular metal reinforcement has a transverse cross-section of substantially 'D' shape but with the straight side of the 'D' being arched slightly away from the curved portion of the 'D'.

5. A frame according to claim 1, in which the tubular metal reinforcement is filled with a plastics material.

6. A frame according to claim 1, in which the tubular metal reinforcement is in the form of an oval shaped loop having one end of the oval inserted into the other end and a pin holding the two ends together.

7. A frame according to claim 1, in which the plastics material in that area of the frame adjacent the point of fastening the handle portion to the head portion is formed to a greater thickness than the remainder of the head of the racquet.

8. A frame according to claim 1, which is for use in a tennis racquet, the tubular metal reinforcement having a major external transverse cross-sectional dimension of from $\frac{3}{8}$ to $\frac{5}{8}$ inch (9.50 to 16.0 mm) and a wall thickness from 0.010 to 0.015 inch (0.25 to 0.40 mm).

9. A frame according to claim 1, which is for use in a squash racquet, the tubular metal reinforcement having a major external transverse cross-sectional dimension of $\frac{1}{4}$ to $\frac{3}{8}$ inch (6.30 to 9.60 mm) and a wall thickness of 0.008 to 0.014 inch (0.20 to 0.36 mm).

10. A frame according to claim 1, which is for use in a badminton racquet, the tubular metal reinforcement having a major external transverse cross-sectional dimension of $\frac{1}{4}$ to $\frac{1}{3}$ inch (6.30 to 8.40 mm) and a wall thickness of 0.006 to 0.012 inch (0.15 to 0.30 mm).

11. A frame according to claim 1 in which the tubular metal reinforcement has unflanged holes spaced between the stringing apertures to assist ingress of plastics material into the tube.

12. A frame according to claim 1 in which the stringing apertures are insulated from the edges of the flanges by a lining of plastics material.

13. A frame according to claim 1 including a second set of flanged stringing apertures in radial alignment with said stringing apertures, said second set of flanged stringing apertures being in the surface of the tubular metal reinforcement which is in contact with the plastics material on the outer periphery and having their flanges extending radially outwardly and into said plastics material.

14. A badminton racquet frame having a head portion and a handle portion, said head portion comprising a loop of moulded plastics material on the outer periphery of the head reinforced with a tubular metal member running around the loop, the member being partially embedded in the plastics material and partially visible and defining the inner periphery of the loop, the member being of substantially 'D' shape in transverse cross-section but with the straight side of the 'D' being arched away from the curved portion of the 'D,' the curved portion of the 'D' being that part of the member that is visible.

15. A badminton racquet frame according to claim 14, in which the major axis of the 'D' is from $\frac{1}{4}$ to $\frac{1}{3}$ inch (6.30 to 8.40 mm), and the minor axis of the 'D' is from 0.170 to 0.200 inch (4.32 to 5.08 mm) and the wall thickness of the tube is from 0.006 to 0.012 inch (0.15 to 0.30 mm).

16. A badminton racquet frame according to claim 14, in which the arching of the 'D' contributes up to one third of the length of the minor axis of the 'D'.

17. A frame for a games racquet, said frame comprising a head portion and a handle portion, said head portion being in the form of a loop having injection-moulded plastics material defining substantially the entire outer periphery thereof and secured to a tubular metal reinforcement, said tubular metal reinforcement running circumferentially around substantially the whole loop and being positioned so that a portion of its circumference is visible and defines substantially the entire inner periphery of said loop.

18. A frame according to claim 17, in which the plastics material is selected from the class consisting of nylon, polypropylene, polycarbonate and acrylonitrile-butadiene-styrene copolymers, and is reinforced with carbon fibres.

19. A frame according to claim 17, in which the tubular metal reinforcement has a transverse cross-section of substantially 'D' shape but with the straight side of the 'D' being arched slightly away from the curved portion of the 'D'.

20. A frame according to claim 17, in which the tubular metal reinforcement is filled with plastics material.

21. A frame according to claim 17, in which the tubular metal reinforcement is in the form of an oval shaped loop having one end of the oval inserted into the other end and a pin holding the two ends together.

22. A frame according to claim 17, in which the plastics material in that area of the frame adjacent the point of fastening the handle portion to the head portion is formed to a greater thickness than the remainder of the head of the racquet.

23. A frame according to claim 17, which is for use in a tennis racquet, the tubular metal reinforcement having a major external transverse cross-sectional dimension of from $\frac{3}{8}$ to $\frac{5}{8}$ inch (9.50 to 16.0 mm) and a wall thickness from 0.010 to 0.015 inch (0.25 to 0.40 mm).

24. A frame according to claim 17, which is for use in a squash racquet, the tubular metal reinforcement having a major external transverse cross-sectional dimension of $\frac{1}{4}$ to $\frac{3}{8}$ inch (6.30 to 9.60 mm) and a wall thickness of 0.008 to 0.014 inch (0.20 to 0.36 mm).

25. A frame according to claim 17, which is for use in a badminton racquet, the tubular metal reinforcement having a major external transverse cross-sectional dimension of $\frac{1}{4}$ to $\frac{1}{3}$ inch (6.30 to 8.40 mm) and a wall thickness of 0.006 to 0.012 inch (0.15 to 0.30 mm).

26. A frame according to claim 17, in which the tubular metal reinforcement has flanged stringing apertures, the flanges extending radially outwards of the head of the frame.

27. A frame according to claim 26, in which the tubular metal reinforcement has unflanged holes spaced between the stringing apertures to assist ingress of plastics material into the tube.

28. A frame according to claim 26 in which the stringing apertures are insulated from the edges of the flanges by a lining of plastics material.

* * * * *